US008016173B2

(12) United States Patent
Dvorak

(10) Patent No.: US 8,016,173 B2
(45) Date of Patent: Sep. 13, 2011

(54) BAG FOR CARRYING CONCRETE FINISHING TOOLS

(76) Inventor: Robert J. Dvorak, Justice, IL (US)

( * ) Notice: Subject to any disclaimer, the term of this patent is extended or adjusted under 35 U.S.C. 154(b) by 851 days.

(21) Appl. No.: 12/015,851

(22) Filed: Jan. 17, 2008

(65) Prior Publication Data

US 2008/0173682 A1 Jul. 24, 2008

Related U.S. Application Data

(60) Provisional application No. 60/881,735, filed on Jan. 20, 2007.

(51) Int. Cl.
*A45F 3/04* (2006.01)

(52) U.S. Cl. ..... 224/653; 224/655; 224/630; 224/580; 383/38

(58) Field of Classification Search ..... 224/264, 224/267, 653, 655, 579, 627, 630, 645, 657, 224/259; 150/112, 117, 130; 190/103, 108, 190/109–11, 125, 127; 383/38–40, 61.1, 383/61.3, 119, 121, 121.1
See application file for complete search history.

(56) References Cited

U.S. PATENT DOCUMENTS

| | | | | | |
|---|---|---|---|---|---|
| 2,479,472 | A | | 8/1949 | Coplon | |
| 3,292,747 | A | * | 12/1966 | Dawson | 190/103 |
| 3,734,365 | A | | 5/1973 | Sprecker | |
| 3,746,151 | A | * | 7/1973 | Brophy et al. | 206/287 |
| 4,096,978 | A | | 6/1978 | Noice | |
| 4,098,376 | A | * | 7/1978 | Pelavin | 190/113 |
| 4,976,388 | A | * | 12/1990 | Coontz | 224/264 |
| 5,152,441 | A | | 10/1992 | Torena | |
| 5,209,384 | A | | 5/1993 | Anderson | |
| 5,341,973 | A | | 8/1994 | Dawes et al. | |
| 5,399,020 | A | * | 3/1995 | Cheng | 383/4 |
| 5,573,166 | A | | 11/1996 | Leja | |
| 5,609,278 | A | | 3/1997 | Fresco | |
| 5,676,293 | A | * | 10/1997 | Farris | 224/576 |
| 5,704,529 | A | * | 1/1998 | Santoro et al. | 224/629 |
| 5,829,874 | A | | 11/1998 | Breeding | |
| 5,913,464 | A | | 6/1999 | Haberlein | |
| 5,957,354 | A | | 9/1999 | Mentken | |
| 6,193,122 | B1 | | 2/2001 | Buckley | |
| 6,230,952 | B1 | | 5/2001 | Jupiter | |
| 6,446,851 | B1 | | 9/2002 | Parks et al. | |
| 6,471,105 | B1 | | 10/2002 | Ammerman et al. | |
| 6,709,196 | B1 | | 3/2004 | Medendorp | |
| 6,805,220 | B2 | | 10/2004 | Fulton et al. | |
| 7,086,255 | B2 | * | 8/2006 | Reason | 70/2 |
| 7,287,904 | B2 | | 10/2007 | Withers | |
| 2005/0236449 | A1 | | 10/2005 | Bird et al. | |

FOREIGN PATENT DOCUMENTS

| | | |
|---|---|---|
| JP | 06263154 A2 | 9/1994 |

* cited by examiner

*Primary Examiner* — Justin M Larson
*Assistant Examiner* — Corey N Skurdal

(57) ABSTRACT

An apparatus for carrying concrete finishing tools comprised of: a front panel, a rear panel, first and second side panels, and a bottom in which the front panel, rear panel, side panels, and bottom form an inner compartment with having an opening to allow access to the inner compartment, a flap extending over the opening, a locking mechanism for temporarily securing the flap to the front panel, at least one shoulder strap to allow the user to carry the apparatus without using their hand(s), and a divider separating the inner compartment into first and second portions.

8 Claims, 5 Drawing Sheets

BAG FOR CARRYING CONCRETE FINISHING TOOLS

CROSS-REFERENCE TO RELATED APPLICATIONS

This application claims the benefit of and priority to U.S. provisional application Ser. No. 60/881,735, filed on 20 Jan. 2007 and incorporated herein in its entirety.

FIELD OF INVENTION

This invention relates generally to the field of storing and transporting construction tools, clothing, and equipment, and in particular to a bag in which concrete finishing tools, clothing, and equipment can be stored and carried.

BACKGROUND

In many professions, individuals, such as concrete finishers, are required to use specialized clothing, equipment, and gear in engaging in the performance of their duties and to transport such items from one location to another. Conventional methods for storing and transporting tools, such as tool boxes and bucket bags, have a number of disadvantages. First, the individual using the tools may be required to climb ladders or perform other physical acts that require the individual to have both hands free at the time. Further, since conventional tool boxes are designed to use only one hand, transporting heavy tools and other equipment becomes increasingly difficult over any distance using a single-handed tool box. In addition, the tool box is not designed to be oriented in any direction since the tools are usually arrayed in trays. Thus, if the tool box becomes upended or turned upside down, the tools can be scattered throughout the tool box.

During construction, workers often need to climb ladders to get to work sites. The Occupational Safety & Health Administration (OSHA) requires that when climbing ladders, the worker maintain three points of contact with the ladder (see 29 CFR 1926.1053(b)(21), "Each employee shall use at least one hand to grasp the ladder when progressing up and/or down the ladder"). A hand-carried tool bag would prevent the worker from maintaining the three points of contact with the ladder, resulting in an unsafe condition and an OSHA violation. In addition, when using a ladder to pass between levels, the worker must often pass through a floor opening (also called a floor hole or a scuttle hole) or a manhole. Oftentimes, the tools carried are longer than the opening is wide, requiring the worker to awkwardly and unsafely carry the tool box. A vertically-oriented bag for carrying concrete finishing tools avoids this problem.

What is needed is an apparatus that allows the user to safely transport tools, clothing, and other equipment between work locations, thus allowing the user to maintain his safety as well as prevent loss of the tools, clothing, and other equipment, which can result in injury to the user, injury to others, and/or damage to other objects.

The term "concrete finishing tools" and "cement finishing tools," as used herein, are used interchangeably and shall generally refer to bull floats, sliders, trowels, knee pads, boots, gloves, goggles, clothing, darbies, groovers, hard floats, ear muffs, ear plugs, levels, cove tools, brushes, files, saws, hammers, measuring tape, nail bars, chalk boxes, carpenter pencils, patch buckets, nose tools, bronze grovers, nail bags, squares, markers, knives, edgers, hand stones, rain gear, and any other equipment that a concrete finisher might use in the normal course in the performance of their work.

The term "D-ring," as used herein refers to any type of metal, plastic, leather, string, cable, cord, webbing, or other ring or loop capable of being used to hold objects, including combinations thereof. D-rings are a permanent part of the strap apparatus and may also include loops secured with fasteners or other configured or molded structures of any material capable of being formed into a closed loop through which a strap, another loop, a hook, or rope may be drawn.

SUMMARY

Figure 1:
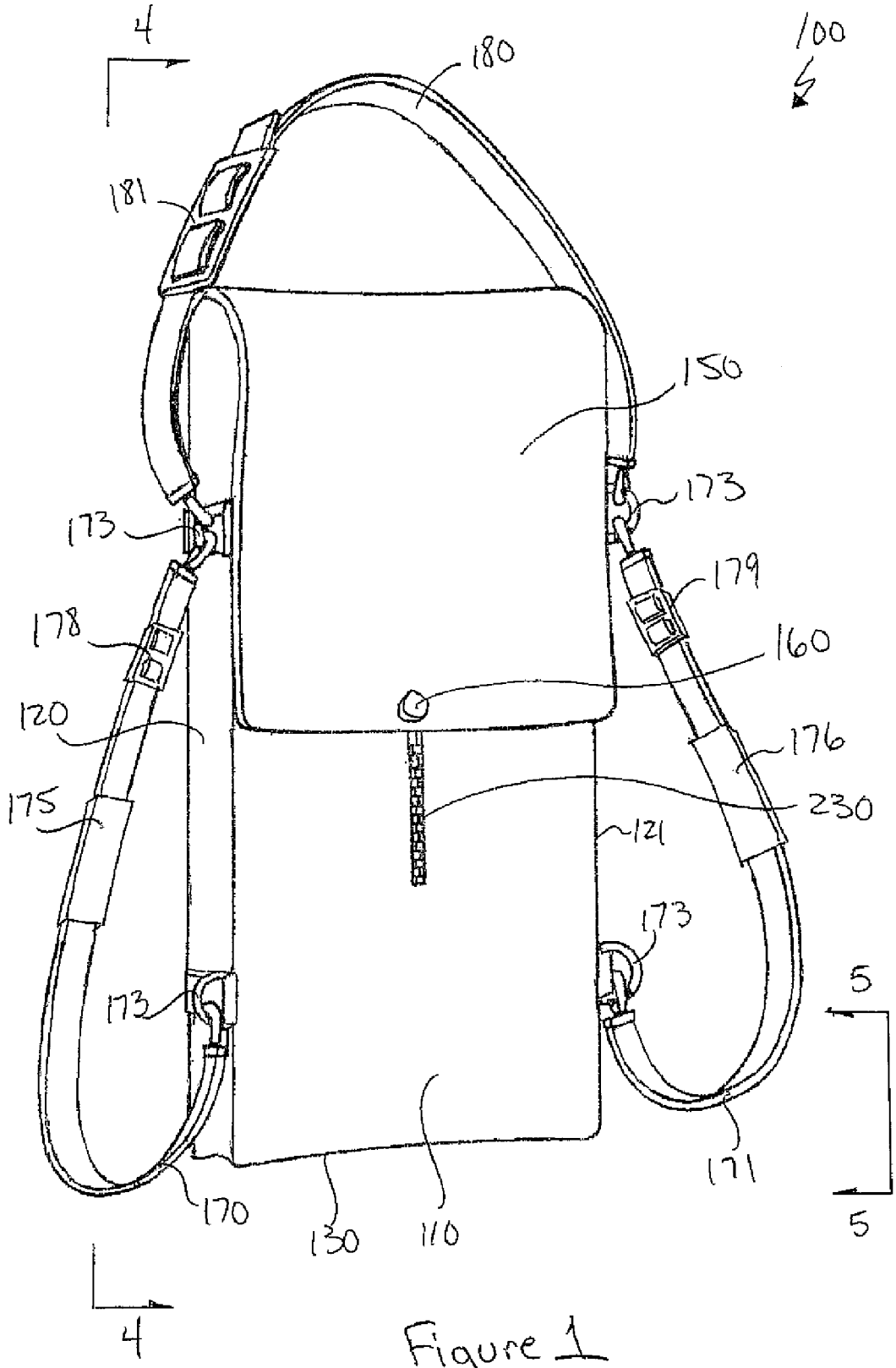
FIG. 1 is a front perspective view of one exemplary embodiment of the bag for carrying concrete finishing tools in a closed position.

An apparatus for carrying concrete finishing tools comprised of: a front panel, a rear panel, first and second side panels, and a bottom in which the front panel, rear panel, side panels, and bottom form an inner compartment with having an opening to allow access to the inner compartment, a flap extending over the opening, a locking mechanism for temporarily securing the flap to the front panel, at least one shoulder strap to allow the user to carry the bag on their back (i.e., without the use of their hands), and a divider separating the inner compartment into first and second portions. Alternate embodiments can further include shoulder pads and/or adjustment members on the shoulder straps, a hand strap to allow the bag to be carried by hand, one or more pockets on the flap and/or front panel, collapsible side panels, a reinforced bottom or back panel, a hole to allow debris and water to pass through the bag, and/or a tapered flap to allow one or more of the concrete finishing tools to extend outward from the bag.

DETAILED DESCRIPTION OF EMBODIMENTS OF THE INVENTION

For the purpose of promoting an understanding of the present invention, references are made in the text hereof to embodiments of a bag for carrying concrete finishing tools, only some of which are depicted in the figures. It should nevertheless be understood that no limitations on the scope of the invention are thereby intended. One of ordinary skill in the art will readily appreciate that modifications such as the dimensions, size, and shape of the components, alternate but functionally similar materials from which the bag for carrying concrete finishing tools is made, and the inclusion of additional elements are deemed readily apparent and obvious to one of ordinary skill in the art, and all equivalent relationships to those illustrated in the drawings and described in the written description do not depart from the spirit and scope of the present invention. Some of these possible modifications are mentioned in the following description. Therefore, specific details disclosed herein are not to be interpreted as limiting, but rather as a basis for the claims and as a representative basis for teaching one of ordinary skill in the art to employ the present invention in virtually any appropriately detailed apparatus or manner.

It should be understood that the drawings are not necessarily to scale, emphasis instead being placed upon illustrating the principles of the invention. In addition, in the embodiments depicted herein, like reference numerals in the various drawings refer to identical or near identical structural elements.

Moreover, the term "substantially" or "approximately" as used herein may be applied to modify any quantitative representation that could permissibly vary without resulting in a change in the basic function to which it is related. For example, one embodiment of the bag for carrying concrete finishing tools is disclosed herein as including a reinforcing layer sewn within the bottom of the bag that is substantially the same shape as the bottom of the bag. The reinforcing layer might permissibly be shaped somewhat different from the shape of the bottom of the bag and still be within the scope of the invention if its functionality is not materially altered.

Referring now to the drawings, FIG. 1 is a front perspective view of one exemplary embodiment of bag 100 for carrying concrete finishing tools in a closed position. Bag 100 is comprised of front panel 110, side panels 120, 121, bottom 130, rear panel (not visible), flap 150, temporary locking mechanism 160, and shoulder straps 170, 171.

Front panel 110, side panels 120, 121, bottom 130, and the rear panel form an inner compartment (not visible; discussed in greater detail infra) into which the concrete finishing tools can be placed. An opening (not visible) allows access to the inner compartment such that the concrete finishing tools can be placed. Flap 150 extends from the rear panel to temporarily cover the opening and zipper (not shown; discuss in detail with respect to FIG. 2). Flap 150 can be integrally formed with the rear panel such that flap 150 and the rear panel are a single piece or flap 150 can be a separate component of bag 100 that is sewn or otherwise attached to the rear panel. In an alternate embodiment of bag 100, flap 150 can be integrally formed with or secured to front panel 110.

In the embodiment shown, front panel 110, side panels 120, 121, bottom 130, the rear panel, and flap 150 are made of number eight (#8) cotton duct canvas, but can alternately be made of any sufficiently flexible and durable material, including other gauges of canvas. The embodiment of bag 100 shown in FIG. 1 is thirty two inches (32") tall, twelve inches (12") wide, and six inches (6") deep, allowing for snug fit of the concrete finishing tools. However, bag 100 can be almost any size or have almost any dimensions.

Also visible in FIG. 1 is temporary locking mechanism 160, which secures flap 150 to front panel 110, thereby covering the opening to the inner compartment of bag 100. In the embodiment shown, temporary securing mechanism 160 is two (2) snaps, each having one (1) portion on the underside of flap 150 and a corresponding portion on front panel 110. However, it should be understood that temporary securing mechanism 160 can be any mechanism to temporarily secure flap 150 over the opening and to front panel 110, including but not limited to grommets that allow flap 150 to be tied (using rope, for example) or clipped (using carabiner, for example) to front panel 110. In addition, for those embodiments in which flap 150 extends from front panel 110 and is temporarily secured to the back panel, temporary securing mechanism 160 would be positioned on flap 150 and the back panel.

Also visible in FIG. 1 are shoulder straps 170, 171, which allows the user to carry bag 100 on their back, freeing their hands. In the embodiment shown, shoulder straps 170, 171 are made of one and one half inch (1½") polypropylene webbing and are secured to bag 100 using D-rings 173, which are each secured to bag 100 at side panels 120, 121. However, shoulder straps 170, 171 can be secured to bag 100, temporarily or permanently, by any means commonly known in the art, including directly to bag 100. Moreover, in another embodiment of bag 100, bag 100 only includes a single shoulder strap 170, allowing the user to sling bag 100 over a single shoulder. The use of D-rings 173 allows shoulder straps 170, 171 a point at which they can be permanently secured to bag (e.g., by sewing) or be temporarily secured to bag (e.g., by a carabiner).

In addition, the embodiment of shoulder straps 170, 171 shown in FIG. 1 further includes shoulder pads 175, 176. Shoulder pads 175, 176 can be permanently on non-permanently secured to shoulder straps 170, 171 and need not be included in every embodiment of bag 100. In addition, in the embodiment shown in FIG. 1, shoulder straps 170, 171 further include adjustment members 178, 179, which allow the user to adjust the length of shoulder straps 170, 171. However, as with shoulder pads 176, shoulder straps 170, 171 need not be included with every embodiment of bag 100.

Also visible in FIG. 1 is hand strap 180. Hand strap 180 allows the user to carry bag 100 by hand for those instances when it is undesirable to carry bag 100 over the user's shoulder. In addition, hand strap 180 is helpful when one (1) worker is passing bag 100 up a ladder or through a floor hole to another worker, as well as providing a place to which a rope can be tied so that bag 100 can be lifted. In the embodiment shown, hand strap 180 is also made of one and one half inch (1½") polypropylene webbing and is secured to bag 100 using D-rings 173. However, instead of being secured to bag 100 using the same D-rings 173 as shoulder straps 170, 171 (as shown), hand strap 180 can be secured to bag 100 using separate D-rings 173 or integrated directly to bag 100 (e.g., sewn to bag). The embodiment of hand strap 180 shown further includes adjustment member 181, which allows the length of hand strap 180 to be adjusted, but need not be included in every embodiment of bag 100.

Figure 2:
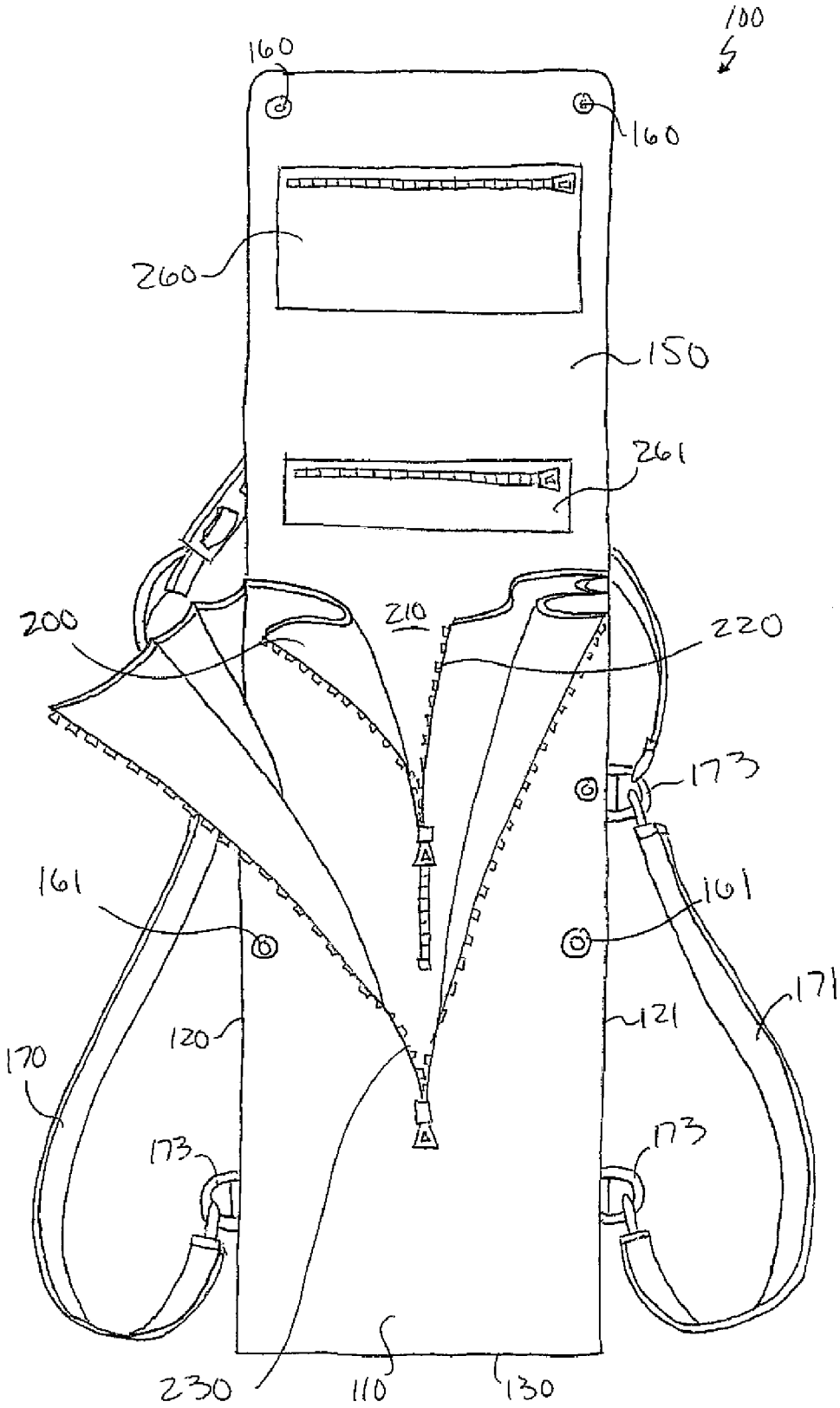
FIG. 2 is a front perspective view of the embodiment of the bag for carrying concrete finishing tools shown in FIG. 1 in an open position.

FIG. 2 is a front perspective view of the embodiment of bag 100 for carrying concrete finishing tools shown in FIG. 1 in an open position. However, the embodiment shown in FIG. 2 does not include the shoulder pads on shoulder straps 170, 171, the adjustment members on shoulder straps 170, 171, and includes two (2) snaps 160, i.e., securing members, on flap 150 that engage snap receivers 161 on front panel 110 of bag 100. As can be seen, bag 100 further includes divider 200, which separates inner compartment 210 into two (2) portions. Divider 200 separates inner compartment 210 into two (2) portions, each being approximately three inches (3") deep. However, in alternate embodiments of bag 100 having alternate dimensions, divider 200 separates inner compartment 210 into two (2) portions of alternate depths. Moreover, divider 200 need not separate inner compartment 210 into two (2) portions having equal dimensions. That is, rear portion of inner compartment 210 can be four (4) inches deep and forward portion of inner compartment 210 can be two (2) inches deep for example.

As can also be seen, both divider 200 and front panel 110 each include zippers 220, 230, respectively, that allow greater access to the two (2) portions of inner compartment 210. In the embodiment shown, each zipper 220, 230 is a number 10

(#10) brass zipper, but either or both can be made of another metal, nylon, plastic, or another similarly durable and functional material. The rear portion of inner compartment 210 is sized to fit two (2) bull floats (not shown) with round or square corners or sliders (not shown) or other similarly shaped concrete finishing tools, and the front portion of inner compartment 210 is sized to fit other concrete finishing tools such as but not limited to trowels, knee pads, boots, gloves, goggles, clothing, darbies, groovers, hard floats, ear muffs, ear plugs, levels.

Also shown in the embodiment of FIG. 2 are pockets 260, 261. Pockets 260, 261 are positioned on the inside of flap 150 and provide additional room to place concrete finishing tools. Other embodiments of bag 100 can include only one (1) pocket 260, 261, no pockets, or additional pockets positioned elsewhere on bag 100, e.g., on the outside of flap 150 or on one (1) or both side panels 120, 121.

Figure 3A:
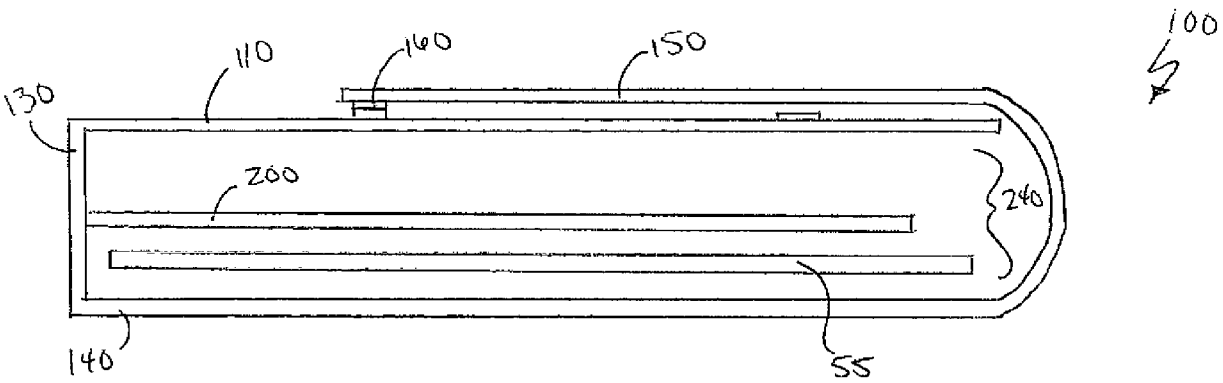
FIGS. 3*a* and 3*b* are each a cross-sectional side view of the embodiment of the bag for carrying concrete finishing tools shown in FIG. 1 holding a bull float.
Figure 3B:
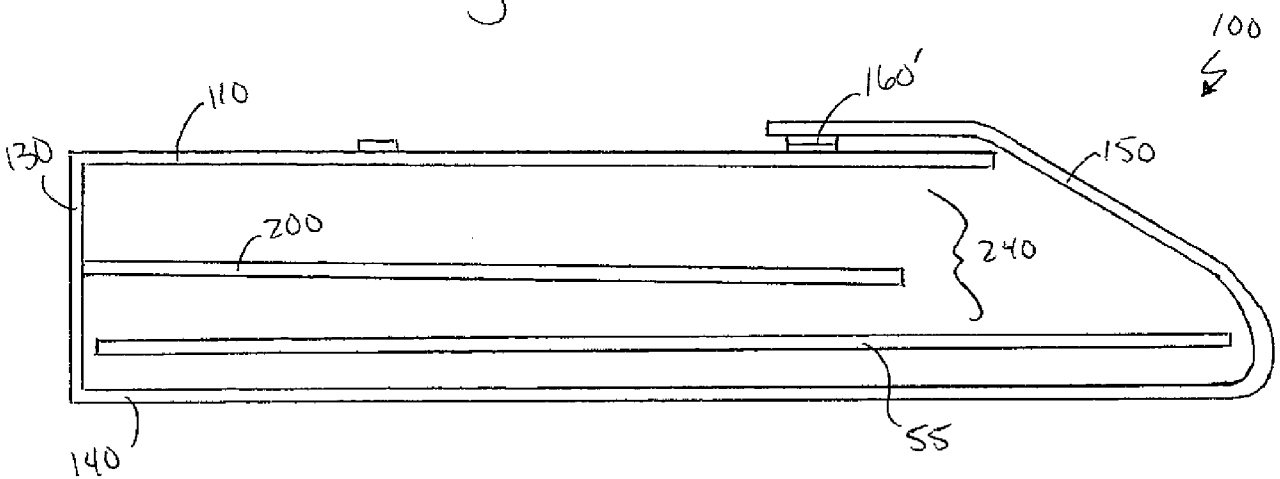

FIGS. 3*a* and 3*b* are each a cross-sectional side view of the embodiment of bag 100 for carrying concrete finishing tools shown in FIG. 1 holding one (1) bull float 55. In both FIG. 3*a* and 3*b*, front panel 110, bottom 130, rear panel 140, flap 150, temporary locking mechanism 160 for temporarily securing flap 150 to front panel 110, divider 200, opening 240, which allows access to inner compartment 210, and one (1) bull float 55. Although only a single bull float 55 is shown for demonstrative purposes, rear portion of inner compartment 210 is sized to accommodate two (2) bull floats 55.

In the embodiment shown in FIG. 3*a*, bull float 55 is thirty inches (30") long and bag is thirty two inches (32") long such that the entire length of bull float 55 fits within bag 100, allowing flap 150 to fold over the opening and be secured to front panel 110 using temporary locking mechanism 160. However, as can be seen in FIG. 3*b*, bag can also accommodate bull float 55 having a length greater than that of bag 100. Specifically, bull float 55 shown in FIG. 3*a* is forty eight inches (48") long, and flap 150 can be secured to temporary locking mechanism 160'. Thus, a single sized bag 100 can accommodate bull floats 55 or other concrete finishing tools of varying sizes.

Figure 4:
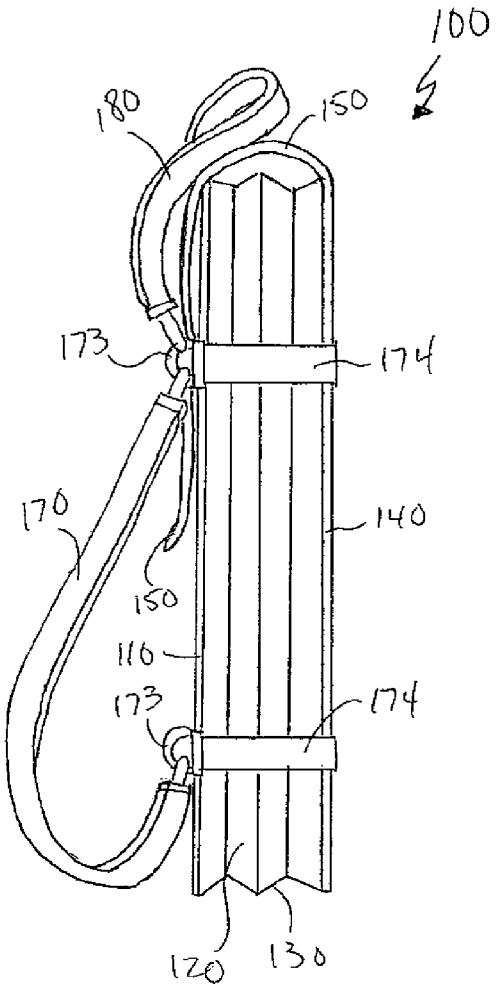
FIG. 4 is a cross-sectional view of the embodiment of the bag for carrying concrete finishing tools shown in FIG. 1 along line 4-4 having collapsible side panels.

FIG. 4 is a cross-sectional view of the embodiment of bag 100 for carrying concrete finishing tools shown in FIG. 1 along line 4-4. As can be seen, bag 100 is comprised of front panel 110, side panel 120, bottom 130, rear panel 140, flap 150 shoulder strap 170 connected to bag by D-rings 173, and hand strap 180. However, in the embodiment shown, side panel 120 (and the other side panel that is not visible) has an accordion-like configuration, which allows bag 100 to more easily flatten out when not in use. Each embodiment of bag 100, however, need not include side panels 120 with this structure. That is, other embodiments can include side panels 120 made of flat fabric, which is still collapsible, but not as easily as shown.

Also visible in FIG. 4 are reinforcing straps 174. D-rings 173 are sewn to reinforcing straps 174, and reinforcing straps 174 prevent bag 100 from tearing at that point. However, it should be understood that D-rings 173 can be secured to reinforcing straps 174 at any point, e.g., at the center of side panel 120, or can be secured directly to side panel 120 or front panel 110.

Figure 5:
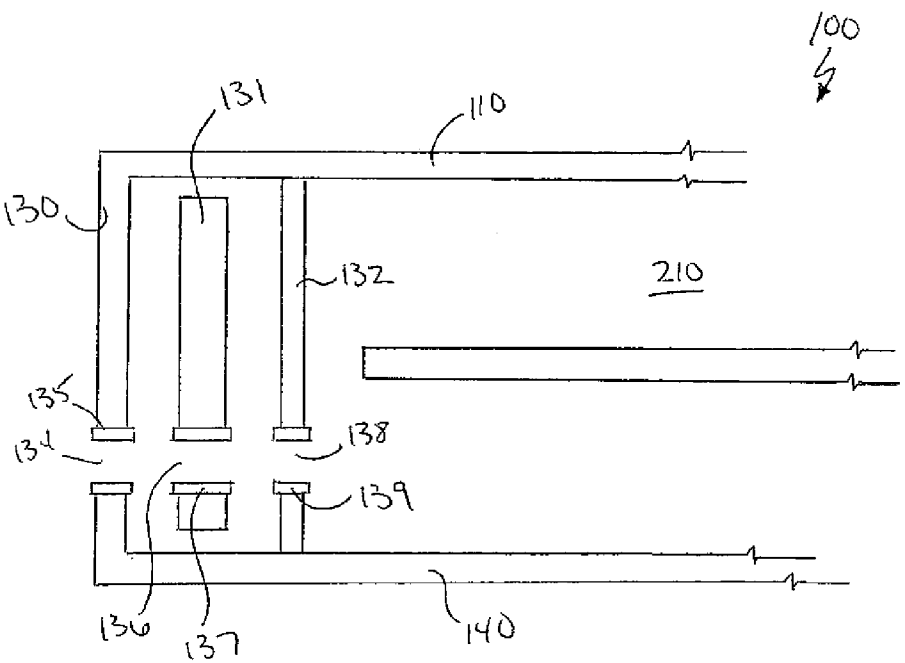
FIG. 5 is a cross-sectional view of one embodiment of the bag for carrying concrete finishing tools further including a reinforced bottom, taken along line 5-5 of FIG. 1.

FIG. 5 is a cross-sectional view of one (1) embodiment of bag 100 for carrying concrete finishing tools further including a reinforced bottom 130, taken along line 5-5 of FIG. 1. Bottom 130, front panel 110, rear panel 140, and divider 200 can all be viewed. In addition, reinforcing layer 131 is sewn between bottom 130 and inner bottom layer 132. Reinforcing layer 131 is thus irremovably secured within bag 100 to prevent bottom from becoming misshapen. In the embodiment shown, reinforcing layer 131 is substantially the same shape as bottom 130 of bag 100, i.e., rectangular, but can be any other shape that prevents bottom 130 from misshaping. Reinforcing layer 131 can be any sufficiently durable and rigid material and can further be water-proof or water-resistant. In addition, in the embodiment shown, bottom 130 further includes aperture 134, reinforcing layer 131 further includes aperture 136, and inner bottom layer 132 further includes aperture 138. Apertures 134, 136, 138 allow water, dirt, and other debris to escape bag 100. Also in the embodiment shown, each aperture 138 is formed by brass grommets 135, 137, 139, thereby preventing apertures 134, 136, 138 from enlarging and allowing any concrete finishing tools or other objects contained within bag 100 to be dropped. It should be understood, however, that each embodiment of bag 100 need not include a reinforced bottom 130, that those embodiments that do include the reinforced bottom 130 need not necessarily include apertures 134, 136, 138, and that those that do include apertures 134, 136, 138 need not include grommets 135, 137, 139. Furthermore, grommets 135, 137, 139 can be of any material commonly known and used in the art. Reinforcing layer 131 is made of wood, but in alternate embodiments of bag 100, reinforcing layer can be made of aluminum or any functionally similar material. Note, too, that back panel 140 can also further include a reinforcing piece (not shown), whether sewn to back panel 140 or inserted within another layer of fabric.

Figure 6:
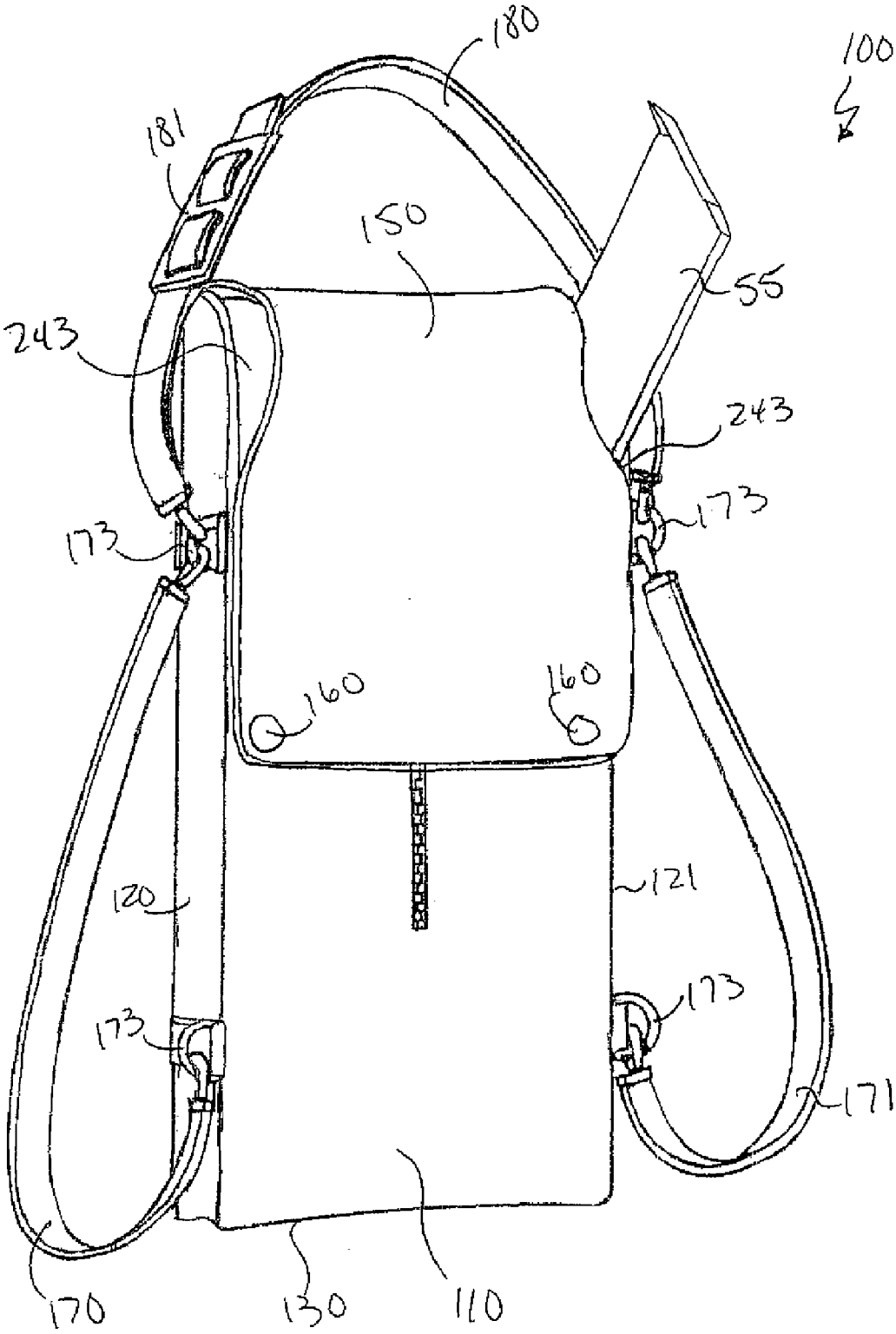
FIG. 6 is a front perspective view of an alternate embodiment of the bag for carrying concrete finishing tools in a closed position further including gaps.

FIG. 6 is a front perspective view of an alternate embodiment of the bag for carrying concrete finishing tools in a closed position further including gaps 243. Gaps 243 are formed by a tapered portion of flap 150. Thus, while flap 150 still covers most of the opening to the inner (not visible), a portion of the opening is exposed, allowing bull float 55 (or multiple bull floats 55) or other concrete finishing tools (e.g., sliders) that are longer than bag 100 to still be carried by bag 100.

In yet other embodiments of bag 100, bag 100 further includes one (1) or more straps secured (permanently or otherwise) to the outside of bag 100. The straps can be sewn to any element of bag 50 or connected to D-rings 173. Such straps can be used to secure additional objects to bag 100, such as a helmet, lunch box, etc.

While the bag for carrying concrete finishing tools has been shown and described with respect to several embodiments and uses in accordance with the present invention, it is to be understood that the same is not limited thereto, but is susceptible to numerous changes and modifications as known to a person of ordinary skill in the art, and it is intended that the present invention not be limited to the details shown and described herein, but rather cover all such changes and modifications obvious to one of ordinary skill in the art.

What is claimed is:

1. A device consisting of:

a front panel with a top edge, two side edges and two pairs of snap portions linearly positioned along said side edges of said front panel on the outer surface of said front panel, said front panel having a first zipper extending vertically from said top edge of said front panel;

a rear panel;

a first side panel with a first pair of D-rings, each of said D-rings located at opposite ends of said first side panel;

a second side panel with a second pair of D-rings, each of said D-rings located at opposite ends of said second side panel;

a bottom with an inner bottom layer;

said front panel, said rear panel, said first side panel, said second side panel, and said bottom forming an inner compartment and having an opening to allow access to said inner compartment;

at least one divider extending between said first side panel and said second side panel and having a top edge and an unattached bottom edge, said divider separating said inner compartment into a first portion and a second portion, said divider further containing a second zipper extending vertically from said top edge of said divider parallel with said first zipper;

a flap with a bottom edge, two side edges and a pair of snap components corresponding to said two pairs of snap portions on said front panel positioned along said side edges on the underside of said flap along said bottom edge, said flap extending over said opening and including a pocket disposed thereon;

two shoulder straps, one of said shoulder straps removably secured to said first pair of D-rings and the other of said shoulder straps removably secured to said second pair of D-rings, said two shoulder straps each including an adjustment member and a pad;

a reinforcing layer of a durable, rigid and water-resistant material irremovably positioned between said bottom and said inner bottom layer; and a reinforced drainage aperture projecting through said bottom, said reinforcing layer and said inner bottom layer, wherein said reinforced drainage aperture is reinforced with at least one grommet;

wherein said device is adapted to hold and allow a user to carry at least one concrete finishing tool.

2. The device of claim 1, wherein said first side panel and said second side panel are collapsible.

3. A bag for carrying at least one concrete finishing tool comprised of:

a front panel with a top edge, two side edges and two pairs of snap portions linearly positioned along said side edges of said front panel on the outer surface of said front panel, said front panel having a first zipper disposed thereon extending vertically from said top edge of said front panel;

a rear panel;

a first side panel with a first pair of D-rings, each of said D-rings located at opposite ends of said first side panel;

a second side panel with a second pair of D-rings, each of said D-rings located at opposite ends of said second side panel;

a bottom with an inner bottom layer;

said front panel, said rear panel, said first side panel, said second side panel, and said bottom forming an inner compartment and having an opening to allow access to said inner compartment;

at least one divider extending between said first side panel and said second side panel and having a top edge and an unattached bottom edge, said divider separating said inner compartment into a first portion and a second portion and including a second zipper disposed thereon, said second zipper extending vertically from said top edge of said divider parallel with said first zipper;

a flap with a bottom edge, two side edges and a pair of snap components corresponding to said two pairs of snap portions on said front panel positioned along said side edges on the underside of said flap along said bottom edge, said flap extending from said rear panel to said front panel and over said opening;

two shoulder straps, one of said shoulder straps removably secured to said first pair of D-rings and the other of said shoulder straps removably secured to said second pair of D-ring;

a reinforcing layer of a durable, rigid and water-resistant material irremovably positioned between said bottom and said inner bottom layer; and a reinforced drainage aperture projecting through said bottom, said reinforcing layer and said inner bottom layer, wherein said reinforced drainage aperture is reinforced with grommets.

4. The bag of claim 3, wherein said first side panel and said second side panel are collapsible.

5. The bag of claim 3, wherein said flap further includes at least one pocket disposed thereon.

6. The bag of claim 3, wherein said device further includes at least one additional strap for supporting additional materials.

7. The bag of claim 3, wherein at least one of said two shoulder straps further includes at least one of an adjustment member and a pad.

8. An apparatus for carrying at least one concrete finishing tool consisting of:

a front panel with a top edge, two side edges and two pairs of snap portions linearly positioned along said side edges of said front panel on the outer surface of said front panel, said front panel having a first zipper disposed thereon extending vertically from said top edge of said front panel;

a rear panel;

a collapsible first side panel with a first pair of D-rings, one of said D-rings secured to the upper portion of said collapsible first side panel and the other of said D-rings secured to the bottom portion of said collapsible first side panel;

a collapsible second side panel with a second pair of D-rings, one of said D-rings secured to the upper portion of said collapsible second side panel and the other of said D-rings secured to the bottom portion of said collapsible second side panel;

a reinforced bottom comprised of a bottom, an inner bottom layer, and a reinforcing layer of a durable, rigid and water-resistant material irremovably positioned between said bottom and said inner bottom layer, said reinforced bottom further including a reinforced drainage aperture projecting through said bottom, said reinforcing layer and said inner bottom layer, wherein said reinforced drainage aperture is reinforced with grommets;

said front panel, said rear panel, said first side panel, said second side panel, and said reinforced bottom forming an inner compartment and having an opening to allow access to said inner compartment;

at least one divider extending between said first side panel and said second side panel and having a top edge and an unattached bottom edge, said divider separating said inner compartment into a first portion and a second portion and including a second zipper disposed thereon extending vertically from said top edge of said divider parallel with said first zipper;

a flap with a bottom edge, two side edges, at least one bull float contour and a pair of snap components corresponding to said two pairs of snap portions on said front panel positioned along said side edges on the underside of said flap along said bottom edge, said flap extending from said rear panel and over said opening and further containing at least one pocket disposed thereon;

two shoulder straps, one of said shoulder straps removably secured to said first pair of D-rings and the other of said shoulder straps removably secured to said second pair of D-rings, at least one of said shoulder straps further including at least one of an adjustment member and a pad;

a hand strap with a first end secured to said D-ring on said upper portion of said collapsible first side panel and a second end secured to said D-ring on said upper portion of said collapsible second side panel; and at least one additional strap for supporting additional materials;

wherein said apparatus is adapted to hold and allow a user to carry at least one concrete finishing tool.

* * * * *